US010233668B2

(12) United States Patent
Kennemer et al.

(10) Patent No.: US 10,233,668 B2
(45) Date of Patent: Mar. 19, 2019

(54) FENCE POST STRAIGHTENER

(71) Applicant: Tractor Supply Company, Brentwood, TN (US)

(72) Inventors: Brian Kennemer, Chapel Hill, TN (US); Ty Rager, Hendersonville, TN (US)

(73) Assignee: Tractor Supply Company, Nashville, TN (US)

( * ) Notice: Subject to any disclaimer, the term of this patent is extended or adjusted under 35 U.S.C. 154(b) by 685 days.

(21) Appl. No.: 14/677,209

(22) Filed: Apr. 2, 2015

(65) Prior Publication Data

US 2016/0290004 A1 Oct. 6, 2016

(51) Int. Cl.
*E04H 17/26* (2006.01)
*B25B 13/50* (2006.01)
*B25B 13/08* (2006.01)

(52) U.S. Cl.
CPC ..... *E04H 17/263* (2013.01); *B25B 13/08* (2013.01); *B25B 13/50* (2013.01)

(58) Field of Classification Search
CPC ..... E04H 17/265
USPC ..... 81/176.1, 119, 58.2, 186, 488, DIG. 8
See application file for complete search history.

(56) References Cited

U.S. PATENT DOCUMENTS 1,276,071 A * 8/1918 Ringling ..... B25B 13/08 81/119
3,103,343 A * 9/1963 Benchley ..... E04H 17/265 24/115 M
3,815,875 A * 6/1974 Koebel, Jr. ..... E04H 17/265 254/132
3,931,749 A * 1/1976 Evans ..... B25B 13/08 81/119
5,009,394 A 4/1991 Marshall
D337,412 S 7/1993 Ruggles
5,499,795 A 3/1996 Mathews
5,681,030 A 10/1997 Nall
8,230,944 B2 7/2012 Thiem
8,465,004 B1 6/2013 Fly
8,701,791 B2 4/2014 Page
2011/0049451 A1* 3/2011 Thiem ..... E04H 17/268 256/1

(Continued)

FOREIGN PATENT DOCUMENTS

CN 204983917 U 1/2016
WO 9906184 A1 2/1999

OTHER PUBLICATIONS

Office Action in corresponding Chinese patent application No. 201510302088.7, dated Dec. 20, 2017, 6 pp (not prior art).

(Continued)

*Primary Examiner* — Monica Carter
*Assistant Examiner* — Lauren Beronja
(74) *Attorney, Agent, or Firm* — Lucian Wayne Beavers; Patterson Intellectual Property Law, PC

(57) ABSTRACT

A wrench apparatus is provided for applying torsion to a T-shape cross-section fence post. A wrench head has a lateral opening so that the wrench head can be placed laterally about the T-shape cross-section post. The wrench head includes first, second and third engagement surfaces arranged to simultaneously engage the three flanges of the fence post so that a torsional load can be simultaneously applied to all three flanges of the fence post.

13 Claims, 5 Drawing Sheets

(56) References Cited

U.S. PATENT DOCUMENTS

| | | | |
|---|---|---|---|
| 2012/0125162 | A1 | 5/2012 | Nguyen |
| 2016/0290004 | A1 | 10/2016 | Kennemer et al. |

OTHER PUBLICATIONS

Exhibit A: Northstar tie rod wrench photos, 2 pp. (dated at least as early as Mar. 10, 2015).
Exhibit B: Printout "Matco Tools—7/8 in Tie Rod Wrench", 1 page. (dated at least as early as Mar. 10, 2015).
Exhibit C: Franklin Industries Co. printout "Agricultural Posts", 6 pp. (dated at least as early as Mar. 10, 2015).

* cited by examiner

FENCE POST STRAIGHTENER

BACKGROUND OF THE INVENTION

1. Field of the Invention

A wrench apparatus is disclosed for applying torsion to a fence post having a T-shape cross-section including a center flange and two side flanges.

2. Description of the Prior Art

A common design for fencing used in the agricultural environment utilizes steel fence posts having a T-shape cross-section. The posts are typically driven into the ground using a heavy post driver that slides over the upper end of the post and is used to impact the upper end of the post to drive it into the ground. Several parallel strands of wire are then strung between adjacent posts to construct the fence.

One issue that is frequently encountered during the construction or maintenance of such fence systems is that the steel posts can become twisted about their cross-section either during installation or due to forces imposed during use.

There is a need for an efficient and effective wrench apparatus for engaging a twisted fence post to apply torsional forces about the longitudinal axis of the post so as to straighten the post for future use.

There particularly is a need for such a wrench apparatus which can be effectively applied to the fence post without having to remove the wires from the post.

SUMMARY OF THE INVENTION

In one embodiment a wrench apparatus is provided for applying torsion to a fence post having a T-shape cross-section including a center flange and two side flanges. The apparatus includes a post driver body having a length of at least 24 inches and a weight of at least 15 pounds. The driver body has first and second ends. A wrench head is attached to one end of the driver body. The wrench head has a lateral opening so that the wrench head can be placed laterally about the T-shape cross-section without having to remove wires from the fence post. The wrench head includes first, second and third engagement surfaces arranged to simultaneously engage the center flange and the two side flanges of the fence post so that a torsional force can be simultaneously applied to all three flanges of the fence post.

The first, second and third engagement surfaces may be arranged such that the three engagement surfaces can simultaneously engage the three flanges in any of three different rotational positions relative to the fence post with the first engagement surface engaging any one of the flanges.

The wrench head may include a central opening defining a partially closed inner perimeter, the central opening being communicated with the lateral opening, the central opening having a length and a width, the lateral opening being located in the length of the center opening.

The first engagement surface may be defined on the inner perimeter adjacent a first end of the lateral opening. The second engagement surface may be defined on an internal protruding portion of the inner perimeter opposite from the lateral opening. The third engagement surface may be defined on a laterally outward extending lip defining a second end of the lateral opening. The laterally outward extending lip may include a V-shape notch.

The three engagement surfaces may each include a straight flat surface having a length of at least 0.2 inches.

Imaginary planes defined by the three straight flat surfaces may be parallel to each other but not mutually intersecting, with each of the straight flat surfaces being at an angle of greater than 90° to each of the other straight flat surfaces.

The wrench head may include two parallel flat opposed sides defining a head thickness between the two sides.

The lateral opening of the wrench head may have a length of 1.1 inch or less.

In another embodiment a tool apparatus is provided for twisting a T-shape cross-section post. The apparatus includes a wrench body including first and second opposed sides defining a body thickness between the opposed sides. The wrench body may have an interior opening defined therein by an interior wall extending between the opposed sides. The interior opening may have a dual lobe shape including a first lobe and a second lobe, and may have an interior opening length between opposite ends of the lobes. The first and second lobes may be partially separated by a laterally inwardly protruding ridge. The interior opening may be communicated with a lateral opening laterally opposite from the ridge. The lateral opening may have a lateral opening length parallel to the interior opening length and less than one-half of the interior opening length. The wrench body may include a first engagement surface defined on an inside surface of the first lobe adjacent the lateral opening, a second engagement surface defined on the laterally inwardly protruding ridge, and a third engagement surface defined in the lateral opening adjacent the second lobe.

The interior opening length may be in a range of from 1.9 inch to 2.2 inch.

Each of the lobes may have an interior opening width of at least 0.8 inch.

The wrench body may have a drive opening defined therein for receiving a drive head of a socket wrench handle, or the wrench body may include a flat stub end defined thereon for welding to a post driver.

Numerous objects features and advantages of the present invention will be readily apparent to those skilled in the art upon a reading of the following disclosure when taken in conjunction with the accompanying drawings.

DETAILED DESCRIPTION

Typical Studded T Post Dimensions

Figure 6:
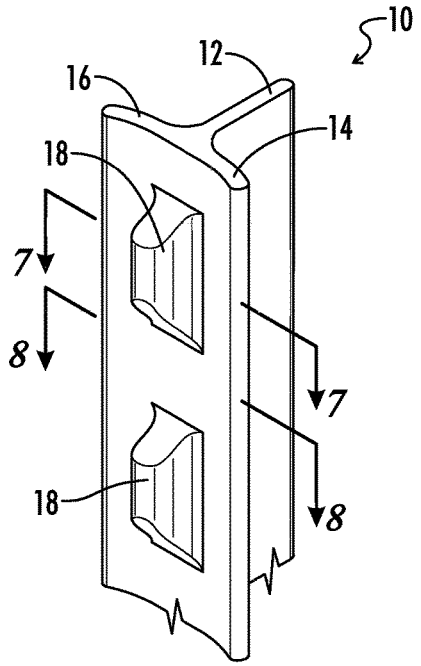
FIG. 6 (PRIOR ART)
FIG. 6 is a perspective view of a typical prior art T-shape cross-section steel fence post.
Figure 7:
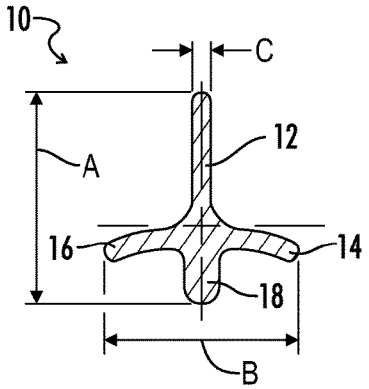
FIG. 7 (PRIOR ART)
FIG. 7 is a cross-sectional view of the post of FIG. 6 taken along line 7-7.
Figure 8:
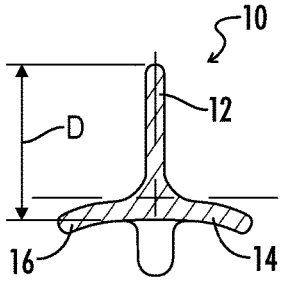
FIG. 8 (PRIOR ART)
FIG. 8 is a cross-sectional view of the post of FIG. 6 taken along line 8-8.

Referring now to FIGS. 6-8 a typical prior art T-shape cross-section steel fence post is shown and generally designated by the numeral 10. As best seen in FIGS. 7 and 8, the post 10 has a T-shape cross-section including a center flange 12 and first and second side flanges 14 and 16.

Protruding oppositely from the center flange 12 between the first and second side flanges 14 and 16 are a plurality of studs 18 spaced apart along the length of the fence post 10.

As best seen in FIGS. 7 and 8 the first and second side flanges 14 and 16 may have a slight curvature away from the center flange 12. Such a post 10 is generally referred to as a studded T post. As will be understood by those skilled in the art, such studded T posts 10 come in a variety of sizes typically defined by the weight of the post per foot of linear length of the post.

For example, the published dimensions for three different weights of studded T posts having the dimensions A, B and C identified in FIG. 7 are shown in the following Table I published by Franklin Industries Co.

TABLE I

Studded T Post Properties

| Weight | Dimensions (Nominal) | | | Area |
|---|---|---|---|---|
| Lbs/Ft | A | B | C | $IN^2$ |
| 0.95 | 1.465 | 1.125 | 0.125 | 0.279 |
| 1.25 | 1.625 | 1.375 | 0.125 | 0.368 |
| 1.33 | 1.635 | 1.375 | 0.130 | 0.391 |

Additionally, the dimension D identified on FIG. 8 is typically about 1.125 inches.

The Wrench Apparatus

Figure 1:
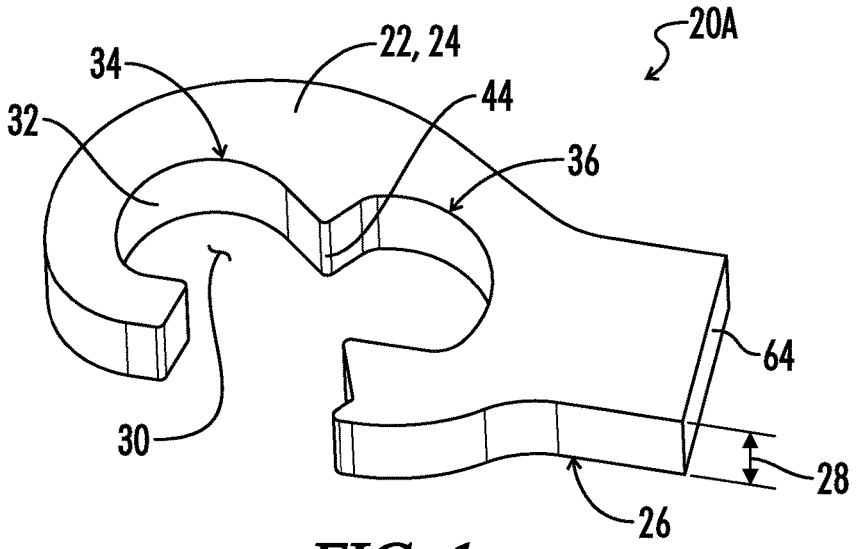
FIG. 1 is a perspective view of a first embodiment of a wrench head designed to be welded to a post driver.
Figure 2:
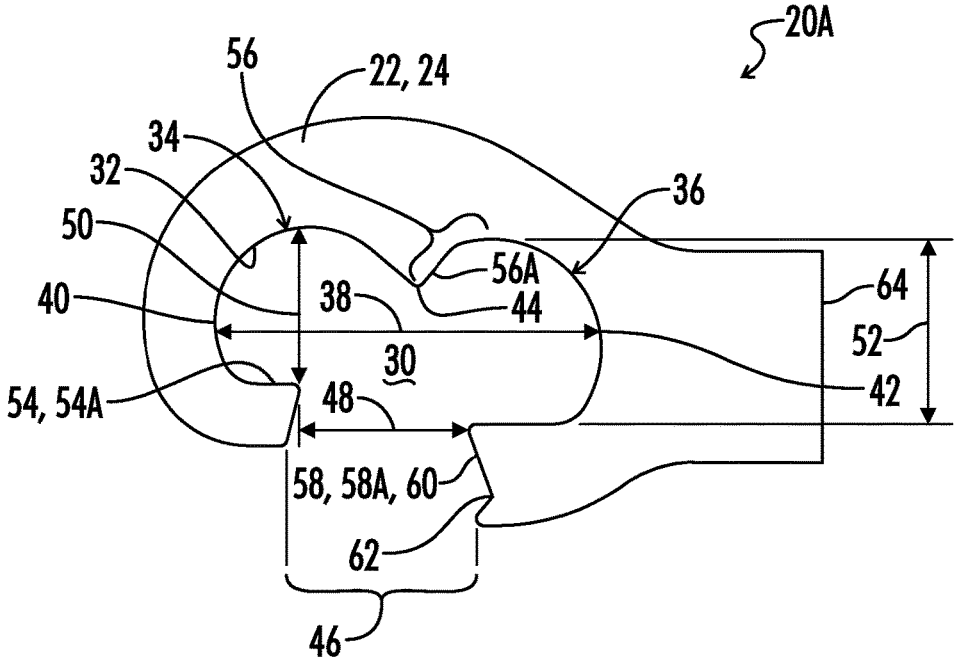
FIG. 2 is a top plan view of the wrench head of FIG. 1.
Figure 3:
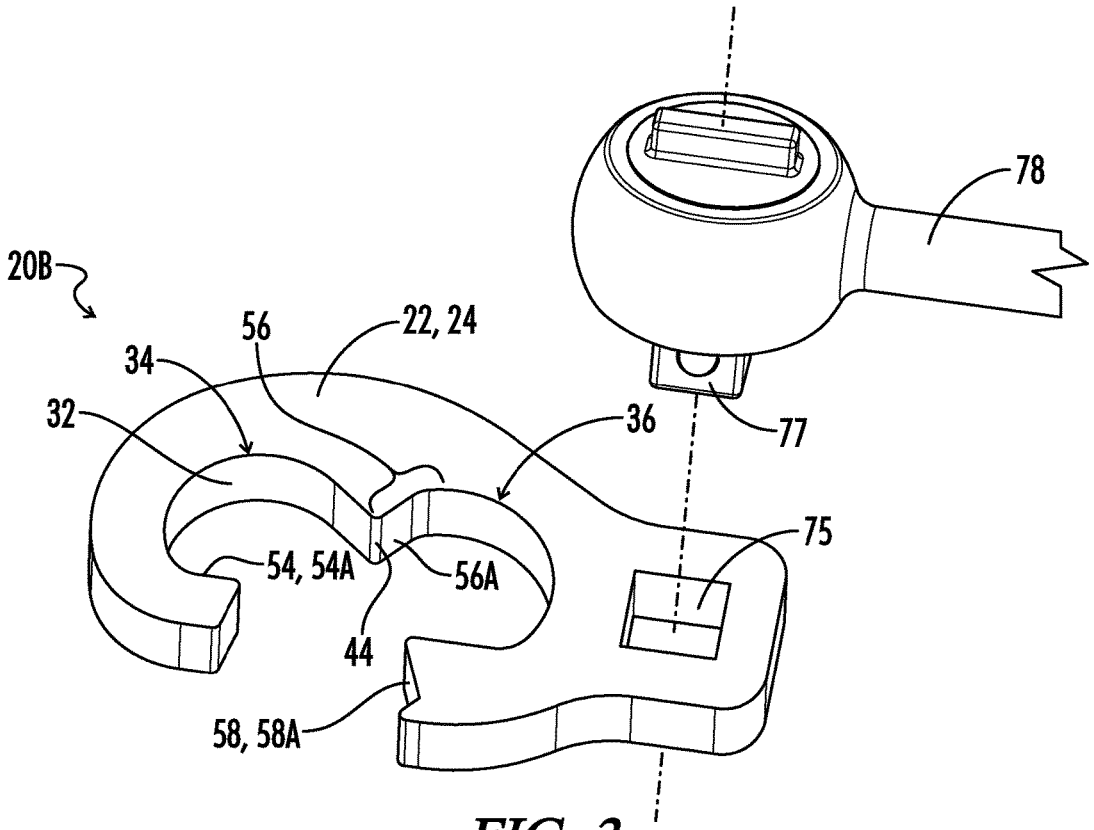
FIG. 3 is a perspective view of a second embodiment of a wrench head designed for engagement with a drive head of a socket wrench handle.
Figure 4:
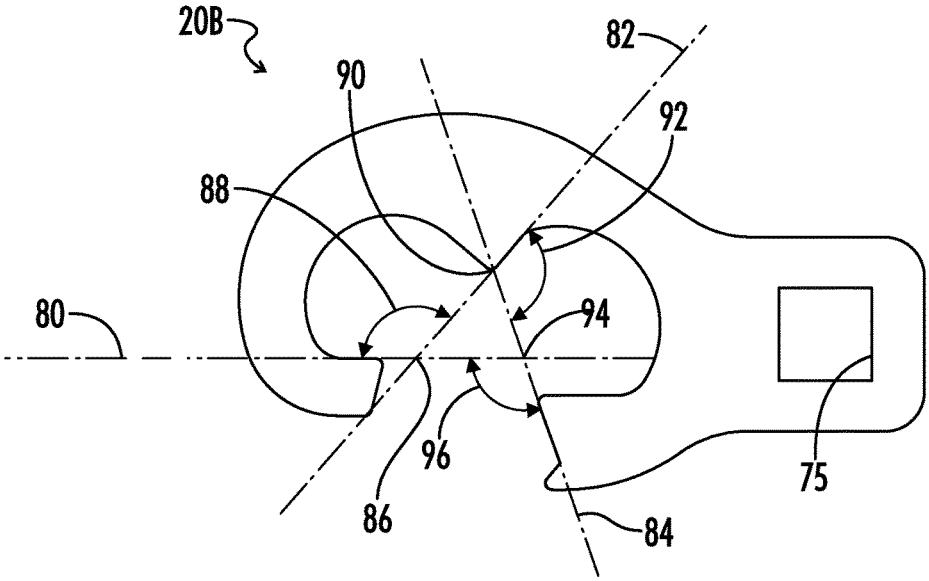
FIG. 4 is a top plan view of the wrench head of FIG. 3.

FIGS. 1 and 2 illustrate the details of a first embodiment 20A of a wrench head designed to be welded to a post driver body, and FIGS. 3 and 4 show similar views of a second embodiment of a wrench head 20B designed for use with a socket wrench handle 78. Other than their means of attachment to a driving device, the wrench head of FIGS. 3 and 4 is substantially identical to the wrench head of FIGS. 1 and 2, and thus only the details of FIGS. 1 and 2 will be described. Analogous components of the wrench head 20B of FIGS. 3 and 4 will use the same identifying numerals as are used in FIGS. 1 and 2 for wrench head 20A.

The wrench head 20A includes a wrench body 22 including first and second opposed sides 24 and 26 defining a body thickness 28 therebetween.

The wrench body 22 has an interior opening 30 defined therein by an interior wall 32 extending between the opposed sides 24 and 26. As best seen in FIG. 2, the interior opening 30 can be described as having a dual lobe shape including a first lobe 34 and a second lobe 36.

The interior opening 30 has an interior opening length 38 between opposite ends 40 and 42 of the lobes 34 and 36.

The first and second lobes 34 and 36 are partially separated by a laterally inwardly protruding ridge 44. The ridge 44 may alternatively be referred to as an internal protruding portion 44 of the inner perimeter 32 opposite from the lateral opening 46.

The interior opening 30 is communicated with a lateral opening 46 laterally opposite from the ridge 44. The lateral opening 46 has a lateral opening length 48 parallel to the interior opening length 38 and preferably less than one-half of the interior opening length 38.

The first lobe 34 has a first lobe interior opening width 50, and the second lobe 36 has a second lobe interior opening width 52.

The interior opening 30 may alternatively be described as a central opening 30 defining a partially closed inner perimeter 32. The central opening 30 is communicated with the lateral opening 48. The central opening 30 has a length 38 and a variable width 50, 52. The lateral opening 46 is located within the length 38 of the central opening 30.

In one embodiment the interior opening length 38 may be in a range of from 1.9 inch to 2.2 inch, and each of the lobes 34 and 36 may have an interior opening width of at least 0.8 inch. Preferably the lateral opening 46 has a length of no greater than 1.1 inch.

In one specific embodiment, the interior opening length 38 may be about 2 1/16 inch, the lateral opening width 48 may be about 15/16 inch, the first lobe interior opening width 50 may be about 13/16 inch, and the second lobe interior opening width 52 may be about 15/16 inch.

A first engagement surface 54 including a substantially straight flat surface 54A is defined on the interior wall 32 of the first lobe 34 adjacent the lateral opening 46.

Figure 10:
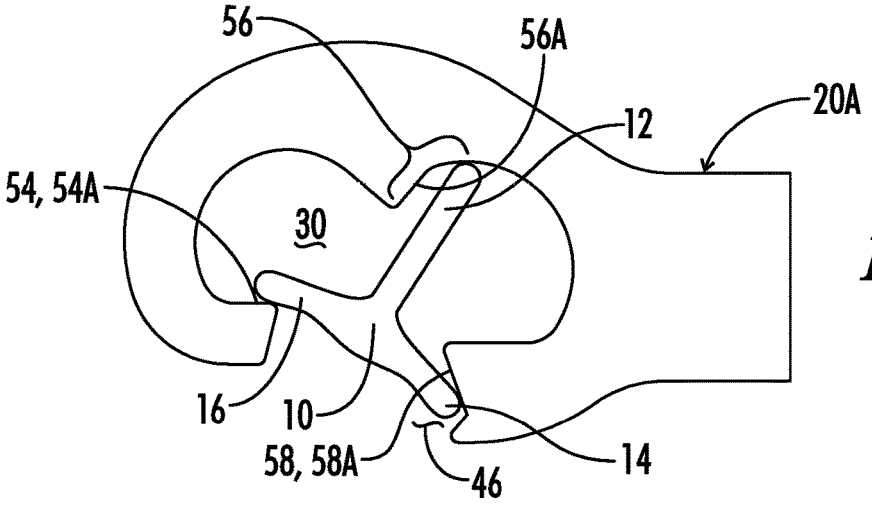
FIG. 10 is a plan view showing the wrench head of FIG. 2 engaged with a T-shape cross-sectional post like that of FIG. 8 in a second position.

A second engagement surface 56 including a substantially straight flat surface 56A is defined on the laterally inwardly protruding ridge 44 on the side thereof facing the second lobe 36. As is best seen in FIG. 10, the second engagement surface can include some curved portion in addition to the substantially straight flat surface 56A.

A third engagement surface 58 including a substantially straight flat surface 58A is defined in the lateral opening 46 adjacent the second lobe 36. More particularly, the third engagement surface 58 is defined on a laterally outwardly extending lip 60 defining an end of the lateral opening 46. The laterally outwardly extending lip may include a V-shape notch 62.

Figure 5:
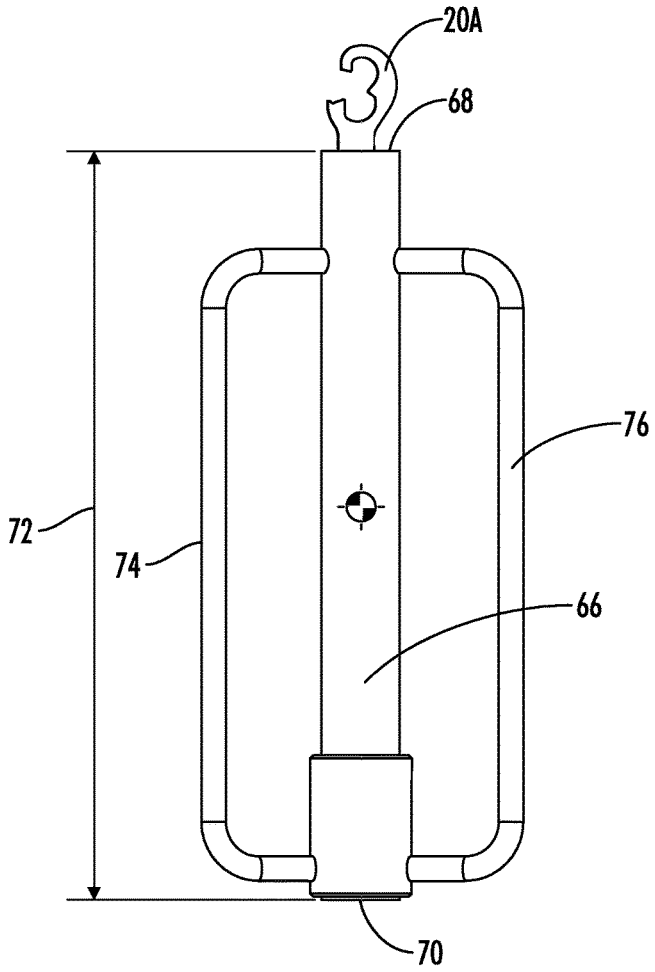
FIG. 5 is a top plan view of a wrench apparatus including a post driver body and a wrench head attached to the post driver body.

The wrench head 20A shown in FIGS. 1 and 2 includes a flat stub end 64 defined thereon and configured to be welded to an end of a post driver body 66 as seen in FIG. 5.

The post driver body 66 has first and second ends 68 and 70 with a length 72 defined therebetween. The second end 70 is open for placement over the upper end of a studded T post 10 for pounding the same into the ground. The upper end 68 of the post driver body is closed. Handles 74 and 76 protrude from the sides of the post driver body so that a worker can grab the two handles and reciprocate the post driver body 66 up and down to impact the top end of the studded T post 10 to drive the same into the ground.

In the embodiment shown in FIG. 5, the wrench head 20A of FIGS. 1 and 2 has been welded to the upper end 68 of the post driver body 66.

If the alternative wrench head 20B of FIGS. 3 and 4 is utilized, the wrench body 22 of wrench head 20B has a drive opening 75 defined therein for receiving a drive head 77 of a socket wrench handle 78 as schematically illustrated in FIG. 3. For example, the drive head 77 may be a square cross-section ½ inch or ¾ inch drive wrench.

Figure 9:
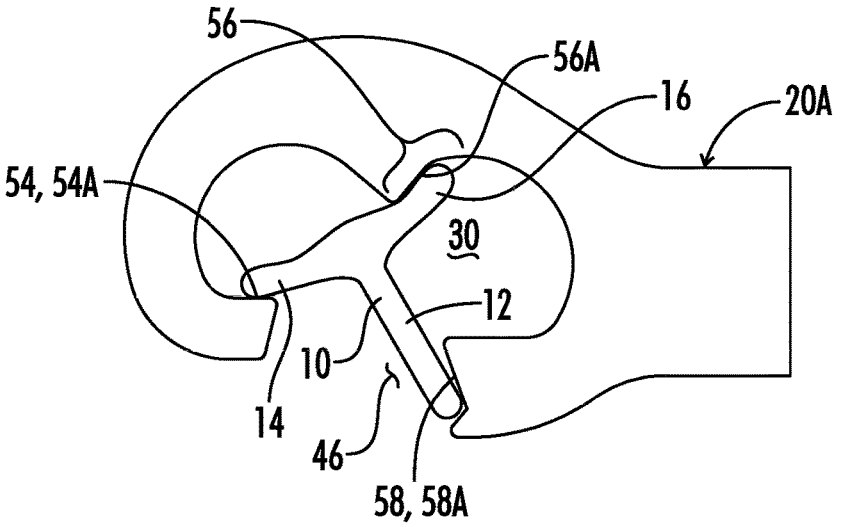
FIG. 9 is a plan view showing the wrench head of FIG. 2 engaged with a T-shape cross-sectional post like that of FIG. 8 in a first position.
Figure 11:
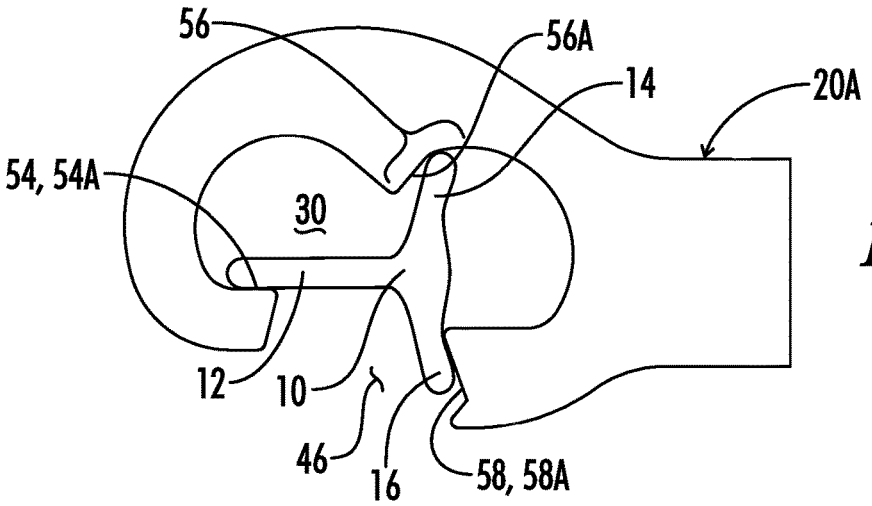
FIG. 11 is a plan view showing the wrench head of FIG. 2 engaged with a T-shape cross-sectional post like that of FIG. 8 in a third position.

As is best appreciated in viewing FIGS. 9-11, the interior opening 30 and the lateral opening 46 of the wrench heads 20A and 20B are shaped and dimensioned so that the wrench head can be placed laterally about the T-shape cross-section of post 10 without having to remove wires from the post. The wrench head, as attached to either the post driver body 66 or the socket wrench handle 78 may be moved in a lateral fashion so that the cross-section of the studded T post 10 moves laterally into the lateral opening 46 and then into the interior opening 30. The wrench head 20A may then be rotated in a clockwise direction so as to engage the three engagement surfaces 54, 56, and 58 with the three flanges of the studded T-shape fence post.

As is seen in FIGS. 9-11, the shape and dimensions of the lateral opening 46 and the interior opening 30 are such that the first, second and third engagement surfaces 54, 56 and 58 can simultaneously engage the three flanges in any of three different rotational positions relative to the fence post 10 with the first engagement surface 54 engaging any selected one of the flanges of the fence post.

Thus, in FIG. 9, the first engagement surface 54 is engaged with the first side flange 14, the second engagement surface 56 is engaged with the second side flange 16 and the third engagement surface 58 is engaged with the center flange 12.

In FIG. 10, a second arrangement is shown wherein the first engagement surface 54 is engaged with the second side flange 16, the second engagement surface 56 is engaged with the center flange 12, and the third engagement surface 58 is engaged with the first side flange 14.

Finally, in FIG. 11, the first engagement surface 54 is engaged with the center flange 12, the second engagement surface 56 is engaged with the first side flange 14, and the third engagement surface 58 is engaged with the second side flange 16.

Also, it will be apparent that the wrench heads 20A and 20B can be flipped over from the orientation shown in FIGS. 1-4 and utilized to engage and twist the studded T-shape fence post 10 in a counterclockwise direction.

Thus a wrench apparatus is provided which can quickly engage all three flanges of a T-shape fence post in a variety of orientations and positions so as to simultaneously engage the three flanges of the fence post and apply a torsional force to straighten any particular portion of the fence post that may need attention.

Each of the first, second and third engagement surfaces 54, 56 and 58 preferably includes a substantially straight portion 54A, 56A and 58A, respectively, having a length of at least 0.2 inch, and the substantially straight portions 54A, 56A and 58A are also preferably substantially flat. As best seen in FIG. 4, imaginary planes 80, 82 and 84 defined by the three straight flat surfaces 54A, 56A and 58A, respectively, can be described as being parallel to each other but not mutually intersecting. Furthermore, each of the straight flat surfaces 54A, 56A and 58A may be described as being at an angle of greater than 90° to each of the other straight flat surfaces. Thus, first and second imaginary planes 80 and 82 intersect at a line 86 and define an obtuse angle 88 therebetween. Second and third imaginary planes 82 and 84 intersect at a line 90 and define an obtuse angle 92 therebetween. Third and first imaginary planes 84 and 80 intersect at a line 94 and define an obtuse angle 96 therebetween.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art which changes are encompassed within the scope and spirit of the present invention as defined by the appended claims.

What is claimed is:

1. A wrench apparatus for applying torsion to a fence post having a T-shape cross-section including a center flange and two side flanges, the apparatus comprising:

a post driver body having a length of at least 24 inches and a weight of at least 15 pounds, the driver body having first and second ends; and a wrench head fixedly attached to one end of the driver body, the wrench head having a lateral opening configured so that the wrench head can be placed laterally about the T-shape cross-section without having to remove wires from the fence post, and the wrench head including first, second and third engagement surfaces arranged to simultaneously engage the center flange and the two side flanges of the fence post so that a torsional force can be simultaneously applied to all three flanges of the fence post; and wherein the wrench head includes a central opening defining a partially closed inner perimeter, the central opening being communicated with the lateral opening, the central opening having a length and a width, the lateral opening being located in the length of the central opening;

wherein the first engagement surface is defined on the inner perimeter adjacent a first end of the lateral opening;

wherein the second engagement surface is defined on an internal protruding portion of the inner perimeter opposite from the lateral opening;

wherein the third engagement surface is defined on a laterally outwardly extending lip defining a second end of the lateral opening; and wherein the laterally outwardly extending lip includes a V-shape notch.

2. A wrench apparatus for applying torsion to a fence post having a T-shape cross-section including a center flange and two side flanges, the apparatus comprising:

a post driver body having a length of at least 24 inches and a weight of at least 15 pounds, the driver body having first and second ends; and a wrench head fixedly attached to one end of the driver body, the wrench head having a lateral opening configured so that the wrench head can be placed laterally about the T-shape cross-section without having to remove wires from the fence post, and the wrench head including first, second and third engagement surfaces arranged to simultaneously engage the center flange and the two side flanges of the fence post so that a torsional force can be simultaneously applied to all three flanges of the fence post;

wherein the first, second and third engagement surfaces are arranged such that the three engagement surfaces can simultaneously engage the three flanges in any of three different rotational positions relative to the fence post with the first engagement surface engaging any one of the flanges.

3. The apparatus of claim 1, wherein:

the three engagement surfaces each include a straight flat surface having a length of at least 0.2 inch.

4. A wrench apparatus for applying torsion to a fence post having a T-shape cross-section including a center flange and two side flanges, the apparatus comprising:

a post driver body having a length of at least 24 inches and a weight of at least 15 pounds, the driver body having first and second ends; and a wrench head fixedly attached to one end of the driver body, the wrench head having a lateral opening configured so that the wrench head can be placed laterally about the T-shape cross-section without having to remove wires from the fence post, and the wrench head including first, second and third engagement surfaces arranged to simultaneously engage the center flange and the two side flanges of the fence post so that a torsional force can be simultaneously applied to all three flanges of the fence post;

wherein the three engagement surfaces each include a straight flat surface having a length of at least 0.2 inch; and wherein imaginary planes defined by the three straight flat surfaces are parallel to each other but not mutually intersecting, with each of the straight flat surfaces being at an angle of greater than 90° to each of the other straight flat surfaces.

5. The apparatus of claim 1, wherein the wrench head includes two parallel flat opposed sides defining a head thickness between the two sides.

6. The apparatus of claim 1, wherein the lateral opening has a length of no greater than 1.1 inch.

7. A tool apparatus for twisting a T-shape cross-section post, comprising:

a wrench body including first and second opposed sides defining a body thickness between the opposed sides, the wrench body having an interior opening defined therein by an interior wall extending between the opposed sides, the interior opening having a dual lobe shape including a first lobe and a second lobe and having an interior opening length between opposite ends of the lobes, the first and second lobes being partially separated by a laterally inwardly protruding ridge, the interior opening being communicated with a lateral opening laterally opposite from the ridge, the lateral opening having a lateral opening length parallel to the interior opening length and less than one-half of the interior opening length, the wrench body having:

a first engagement surface defined on an inside surface of the first lobe adjacent the lateral opening;

a second engagement surface defined on the laterally inwardly protruding ridge; and a third engagement surface defined in the lateral opening adjacent the second lobe; and wherein:

the third engagement surface is defined on a laterally outwardly extending lip defining an end of the lateral opening; and the laterally outwardly extending lip includes a V-shape notch.

8. The apparatus of claim 7, wherein each engagement surface includes a straight flat surface.

9. The apparatus of claim 8, wherein:

imaginary planes defined by the straight flat surfaces of the three engagement surfaces are parallel to each other but not mutually intersecting, with each of the straight flat surfaces being at an angle of greater than 90° to each of the other straight flat surfaces.

10. The apparatus of claim 7, wherein the interior opening length is in a range of from 1.9 inch to 2.2 inch.

11. The apparatus of claim 10, wherein:

each of the lobes has an interior opening width of at least 0.8 inch.

12. The apparatus of claim 7, wherein the wrench body has a drive opening defined therein for receiving a drive head of a socket wrench handle.

13. The apparatus of claim 7, wherein the wrench body includes a flat stub end defined thereon for welding to a post driver.

* * * * *